US007819168B2

(12) United States Patent
Hunter

(10) Patent No.: US 7,819,168 B2
(45) Date of Patent: Oct. 26, 2010

(54) METHOD AND APPARATUS FOR TRANSFERRING SAND INTO FLASK OF MOLDING MACHINE

(75) Inventor: William Gary Hunter, Barrington, IL (US)

(73) Assignee: Hunter Automated Machinery Corporation, Schaumburg, IL (US)

( * ) Notice: Subject to any disclaimer, the term of this patent is extended or adjusted under 35 U.S.C. 154(b) by 512 days.

(21) Appl. No.: 11/494,563

(22) Filed: Jul. 27, 2006

(65) Prior Publication Data

US 2008/0023171 A1 Jan. 31, 2008

(51) Int. Cl.
*B22C 15/24* (2006.01)

(52) U.S. Cl. ..... 164/22; 164/200

(58) Field of Classification Search ..... 164/19, 164/20, 21, 22, 200, 201, 202
See application file for complete search history.

(56) References Cited

U.S. PATENT DOCUMENTS 4,589,467 A 5/1986 Hunter
4,590,982 A 5/1986 Hunter
4,657,064 A 4/1987 Hunter
4,671,339 A 6/1987 Hunter
4,699,199 A 10/1987 Hunter
4,738,299 A 4/1988 Hunter
4,840,218 A 6/1989 Hunter
4,848,440 A 7/1989 Hunter
4,890,664 A 1/1990 Hunter
5,022,512 A 6/1991 Hunter
5,069,268 A 12/1991 Hunter
5,101,881 A 4/1992 Hunter
5,170,836 A 12/1992 Hunter
5,291,936 A * 3/1994 Rommel et al. ..... 164/22
5,343,928 A 9/1994 Hunter
5,402,938 A 4/1995 Sweeney
5,458,180 A * 10/1995 Landua et al. ..... 164/20
5,524,703 A * 6/1996 Landua et al. ..... 164/200
5,597,029 A * 1/1997 Landua ..... 164/200
5,853,042 A 12/1998 Hunter
5,901,774 A 5/1999 Hunter et al.
5,927,374 A 7/1999 Hunter et al.
5,971,059 A 10/1999 Hunter et al.
6,015,007 A 1/2000 Hunter et al.
6,145,577 A 11/2000 Hunter et al.
6,263,952 B1 7/2001 Hunter
6,533,022 B2 3/2003 Hunter
6,571,860 B2 6/2003 Hunter et al.
6,622,772 B1 9/2003 Hunter (Continued)

OTHER PUBLICATIONS http://www.exair.com/linevac/lv.frmain2.htm, *EXAIR*® Line Vac™, (2 pages), printed from website May 1, 2006.

*Primary Examiner*—Kevin P Kerns
(74) *Attorney, Agent, or Firm*—Pauley Petersen & Erickson

(57) ABSTRACT

An air amplifier apparatus and method for transferring or filling sand particles into a flask of a molding machine. A plurality of nozzles are each mounted with respect to the molding machine. A pressurized fluid, such as discharged from an air compressor or other pressure forming device, delivers pressurized fluid into each nozzle. The pressurized fluid flows through a passageway of each nozzle and can follow a Coanda profile as it accelerates the particles through the passageways. The accelerated particles are then discharged into a void formed by the flask of and pattern in the molding machine.

26 Claims, 6 Drawing Sheets

U.S. PATENT DOCUMENTS 6,779,586 B2 8/2004 Hunter et al.
6,817,403 B2 11/2004 Hunter
7,150,310 B2 12/2006 Hunter et al.
2004/0250977 A1* 12/2004 Stauder ..... 164/20
2005/0109478 A1 5/2005 Hunter et al.

* cited by examiner

METHOD AND APPARATUS FOR TRANSFERRING SAND INTO FLASK OF MOLDING MACHINE

BACKGROUND OF THE INVENTION

1. Field of the Invention

This invention provides an air amplifier for use as an apparatus and in a method for filling a flask of a molding machine, whereby sand particles originally falling into the flask only by gravity are now accelerated upon exiting amplifier nozzles. The accelerated sand particles are directed or slung (as in sand slinger) toward a pattern plate and flask mounted within a molding machine.

2. Discussion of Related Art

Some conventional molding machines use gravity feed systems to fill a cope flask and a drag flask with sand. During the fill procedure, green sand is loaded into a measuring hopper. The hopper is then opened and the sand falls by gravity into and fills a space defined by the flask and a pattern plate.

In other conventional molding machines, sand is pneumatically blown into a void/space defined by a flask and a pattern plate. In some, if not all, pneumatically blown fill processes, a seal is formed between the flask and the device that feeds the pneumatically blown sand. Flasks used with a pneumatically blown filling device require a vented structure, such as one or more screens or vents, so that air can discharge from the flask without carrying the sand outside of the flask. The seals and also the vented flasks require undesirable maintenance, for example to keep the vents open and properly operating. Machines of this closed fill design also do not provide the flexibility or access that is desired in the production of many castings, such as, for example, the use of chaplets, ram up cores, exothermic risers, etc.

SUMMARY OF THE INVENTION

It is one object of this invention to provide an apparatus for filling a cope flask and/or a drag flask of a molding machine by using nozzles to accelerate and direct sand particles into a void formed by a flask structure.

It is another object of this invention to provide a method for filling the cope flask and/or the drag flask in a timely manner, to achieve better time and motion efficiency of the molding machine.

The above and other objects of this invention are accomplished with a distribution apparatus mounted upstream with respect to a flask to be filled. The distribution apparatus has a plurality of nozzles, such as, for example, air amplifier nozzles, that can receive sand, for example gravity fed sand, and distribute the sand into the different nozzles. The nozzles can be arranged in any suitable pattern or array, depending upon the intended use or the type of pattern mounted within the corresponding flask.

Each nozzle can have a pressurized fluid, such as air, flowing through a passageway of the nozzle. The pressurized fluid passes through openings within the nozzle and increases the velocity of fluid flowing through the nozzle. In one embodiment, the nozzles include a pressurized fluid inlet, a Coanda profile, and/or a mixed fluid outlet.

As the sand falls by gravity from a hopper, the sand enters an inlet of each nozzle. The pressurized fluid flowing through the nozzle draws the sand into and through the passageway of the nozzle and accelerates the sand as it travels through the passageway of the nozzle. The sand discharges through an outlet of the nozzle and is directed toward a void formed by the flask.

Any nozzle can be adjustably mounted with respect to the mold or the flask, so that the flow of accelerated sand can be directed or aimed into the void of the flask. For example, any one or more of the nozzles can be aimed at or near a pattern mounted within the void of the flask.

The accelerated sand particles can provide denser compaction and/or more uniform compaction of the sand about the pattern, and can desirably reduce or eliminate, for example, the need for conventional hand ramming to achieve the desired mold quality.

A computer, controller or other calculating device can be programmed and used to achieve different flow parameters of the sand through the nozzle, and also to change the position of each nozzle with respect to the flask.

Upstream of the nozzles, funnels or funnel inlets can be used to distribute the gravity fed sand into corresponding nozzles. Each funnel or funnel inlet can have a shape of a truncated cone, for example that converges in a direction toward the corresponding nozzle. The funnels or funnel inlets can be positioned next to each other to reduce or eliminate horizontal surfaces that would otherwise catch or collect sand and interfere with distribution and/or flow of the sand.

BRIEF DESCRIPTION OF THE DRAWINGS

The above and other features and objects of this invention are better understood from the following detailed description taken in view of the drawings, wherein.

DETAILED DESCRIPTION OF THE INVENTION

Molding machine 20 of this invention can be used in connection with molding technology, including molds that use green sand. U.S. Pat. No. 6,622,772, the entire disclosure of which is incorporated into this specification by reference, describes background technology that could be applied to this invention.

Figure 1:
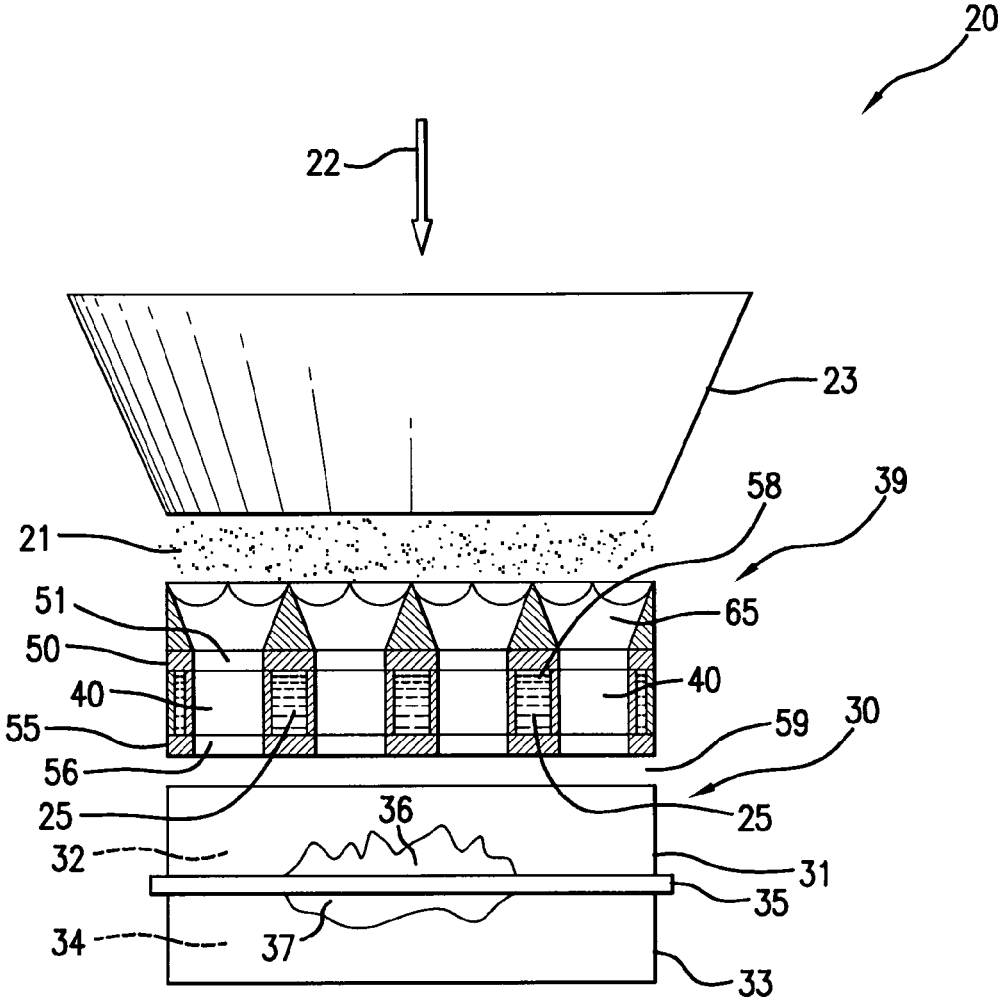
FIG. 1 is a schematic partial sectional view of certain elements of a molding machine, according to one embodiment of this invention.

FIG. 1 shows certain elements of molding machine 20, according to one embodiment of this invention. Particles 21 are delivered, such as through source or supply 22, to any suitable hopper 23, such as a variable volume hopper, or any other suitable feed or supply device for delivering particles 21. Supply 22 can be manually and/or automatically opened and/or volume controlled, to permit particles 21 to flow in a downstream direction. As used throughout the specification and in the claims, the terms upstream and downstream relate to a direction of normal flow of particles 21 entering supply 22, passing through hopper 23 and entering nozzles 40. For example, the downstream direction is from the top to the bottom, as shown in FIG. 1.

Particles 21 may comprise green sand normally used with molding machines, or any other suitable sand or other particulate substance that can be used in molding machine 20.

As shown in FIG. 1, molding machine 20 comprises mold 30 having cope flask 31 and drag flask 33, which can be connected or mounted with respect to each other using matchplate 35 or any other suitable connector known to those skilled in the art of molding machines. Cope flask 31 forms void 32 in which pattern 36 can be mounted or otherwise positioned. Drag flask 33 forms void 34 in which pattern 37 can be mounted or otherwise positioned. Void 32 and 34 can have any suitable shape and/or dimensions that accommodates the corresponding pattern 36 or 37.

Figure 4:
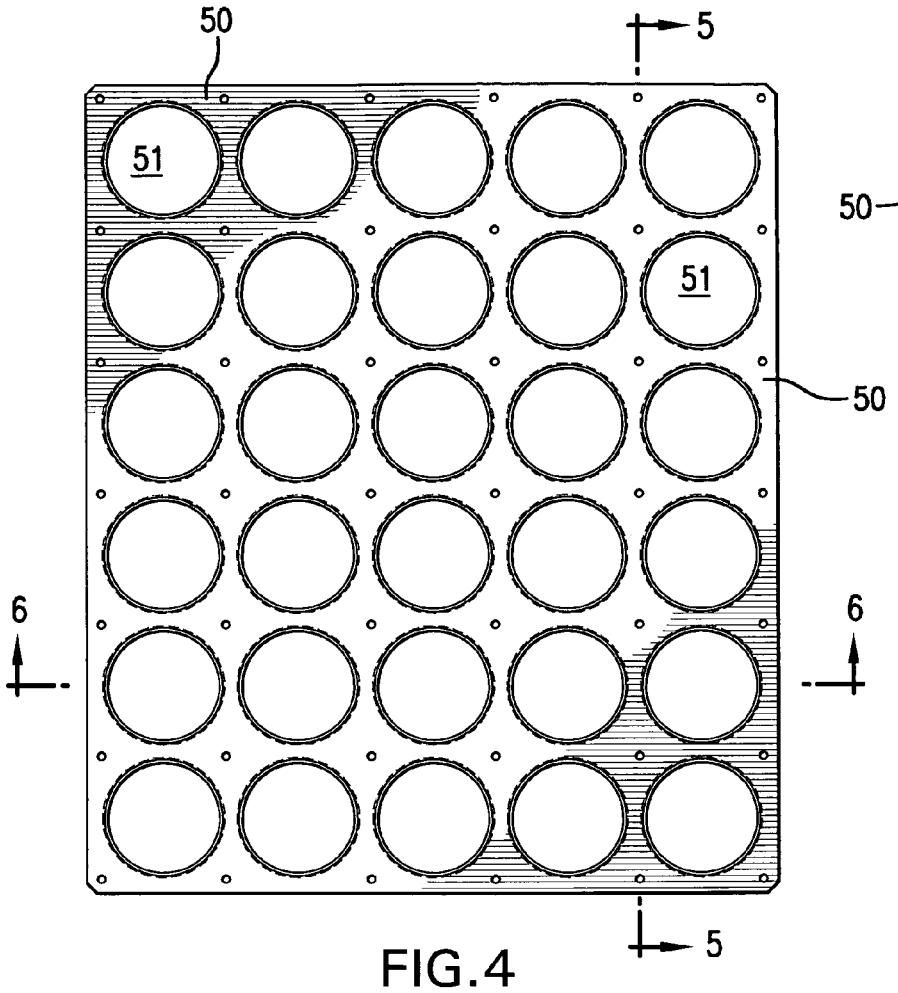
FIG. 4 is a top view of an upstream plate, according to one embodiment of this invention.
Figure 5:
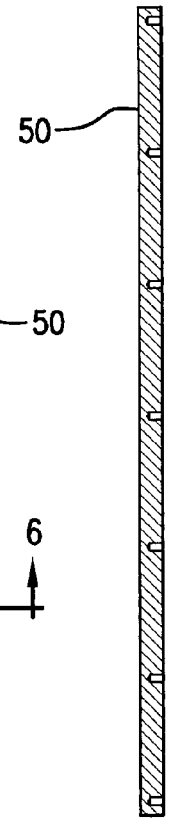
FIG. 5 is a sectional view, taken along line 5-5, as shown in FIG. 4.
Figure 6:
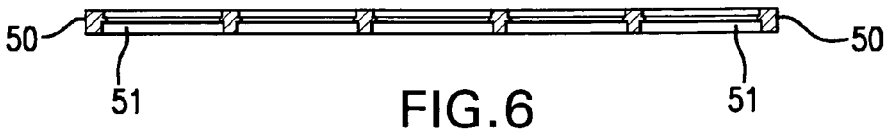
FIG. 6 is a sectional view, taken along line 6-6, as shown in FIG. 4.
Figure 7:
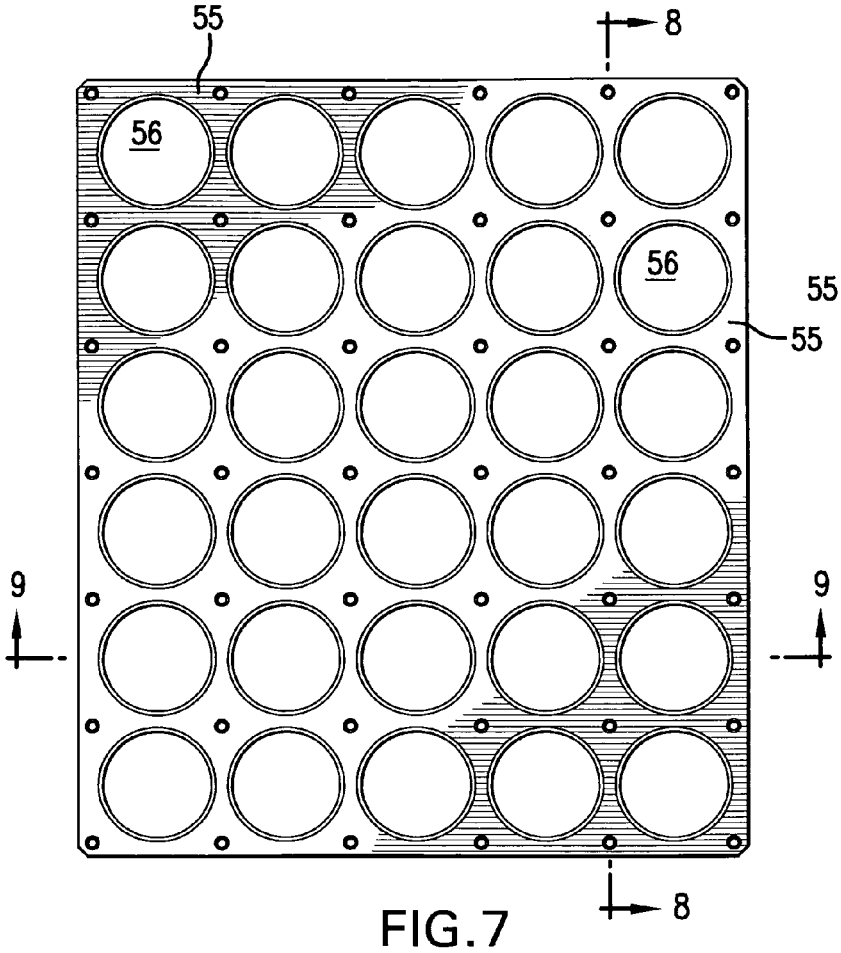
FIG. 7 is a top view of a downstream plate, according to one embodiment of this invention.
Figure 8:
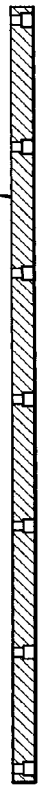
FIG. 8 is a sectional view, taken along line 8-8, as shown in FIG. 7.
Figure 9:
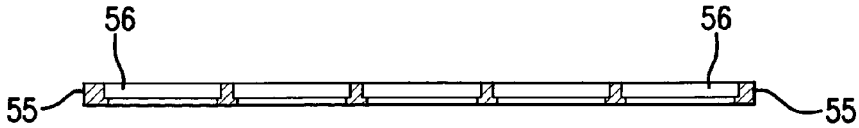
FIG. 9 is a sectional view, taken along line 9-9, as shown in FIG. 7.

In certain embodiments of this invention, distributor 39, which receives and discharges particles 21, comprises nozzles 40 and/or structural elements directly or indirectly connected or attached to nozzles 40. As shown in FIG. 1, four nozzles 40 are mounted with respect to molding machine 20 and/or mold 30. FIGS. 4 and 7 illustrate a 5×6 array or thirty positions for corresponding nozzles 40. Any other number, shape and/or arrangement of nozzles 40 can be used, according to this invention.

Figure 2:
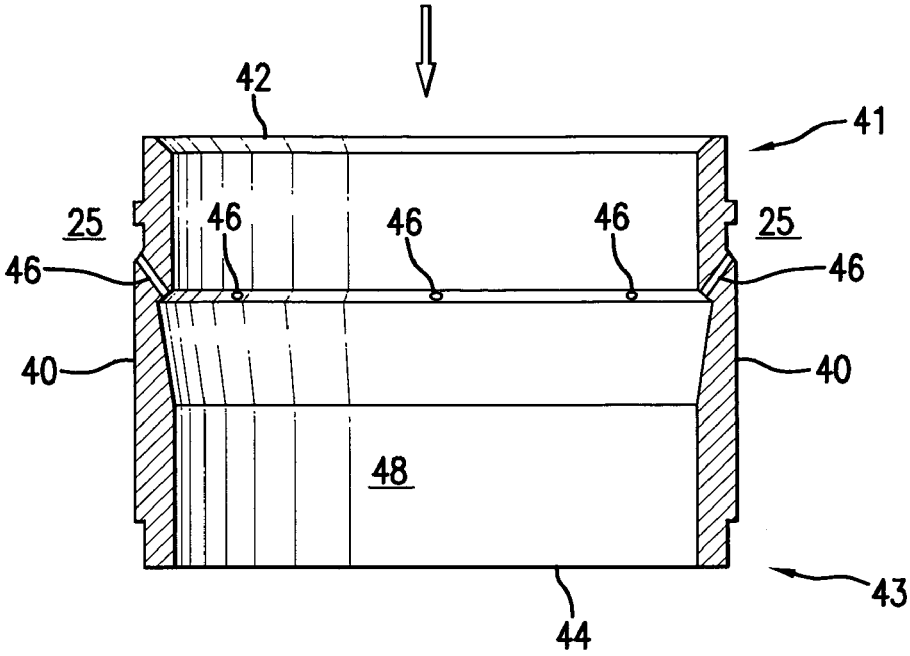
FIG. 2 is a longitudinal sectional view of a nozzle, taken along a centerline, according to one embodiment of this invention.

FIG. 2 shows each nozzle 40 having inlet 42 and outlet 44. Inlet 42 is positioned with respect to or is in communication with supply 22 of particles 21, for receiving or allowing particles 21 to enter passageway 48 of nozzle 40. Inlet 42 can be positioned at upstream end 41 of distributor 39. Outlet 44 can be positioned at downstream end 43 of distributor 39, so that particles 21 discharge through outlet 44 and travel into void 32 or 34.

Pressurized fluid 25 can comprise any suitable gas or liquid used to carry particles 21. For example, pressurized fluid 25 can be pressurized air or any other pressurized gas.

Figure 12:
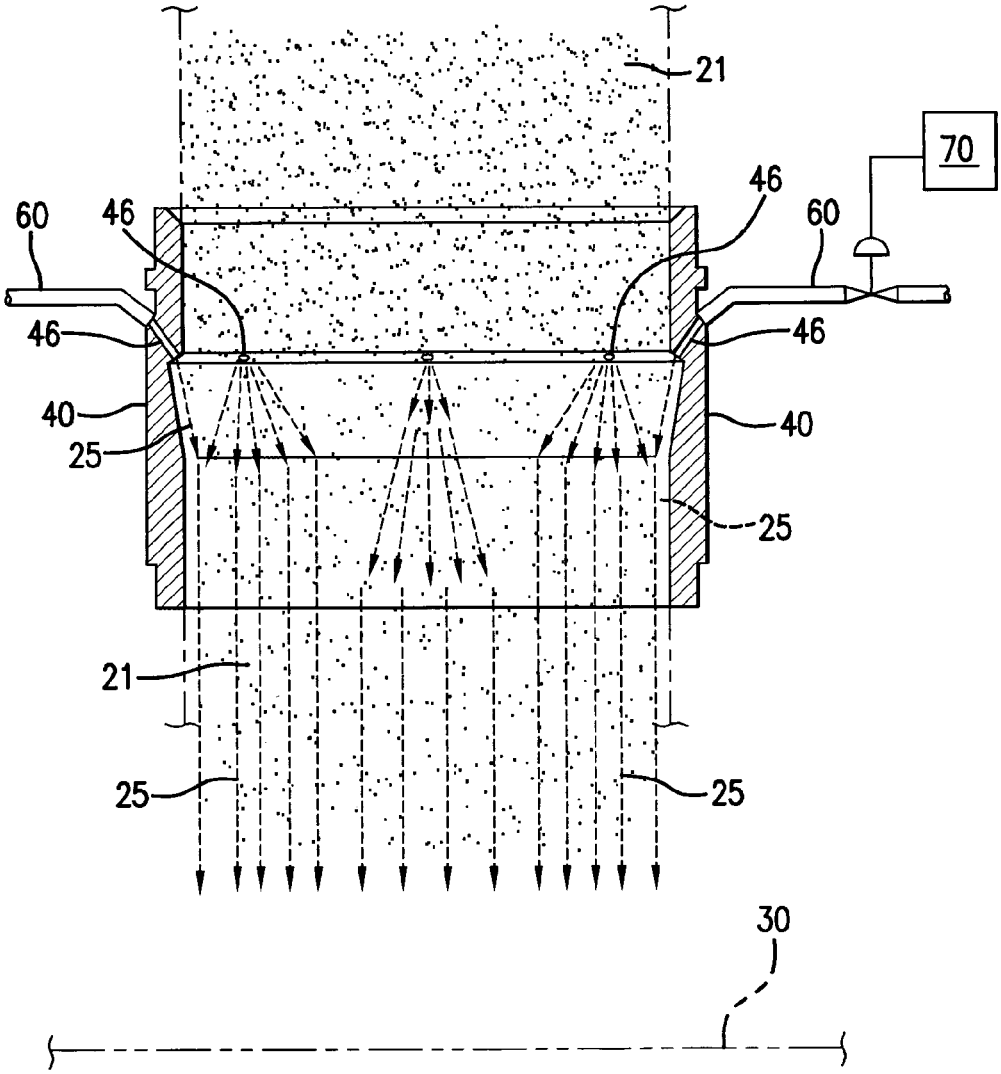
FIG. 12 is a sectional view of the nozzle shown in FIG. 2, but with diagrammatic arrows showing how pressurized air enters the nozzle and accelerates the particles through the nozzle.

Pressurized fluid 25, such as shown in FIG. 2, passes through passageway 48 and discharges through outlet 44. As illustrated in FIG. 12, pressurized fluid 25 draws particles 21 into the flow field established within passageway 48, and accelerates particles 21, such as indicated by the increasing length of flow arrows, within or through passageway 48. The flow stream established by pressurized fluid 25 can be directed or aimed so that discharged particles 21 are transferred into void 32 or 34, for example at or near pattern 36 or 37.

The acceleration and thus the increased velocity of particles 21 can provide better or denser compaction and/or more uniform compaction of particles 21 about, at or near pattern 36 or 37.

In certain embodiments according to this invention, each nozzle 40 is attached to plate 50. FIGS. 1-3 and 6 illustrate how an upstream end portion of nozzle 40 is mounted within bore 51 of plate 50. Bore 51 forms fluidic communication with inlet 42 of nozzle 40.

A downstream end portion of nozzle 40 can be attached to plate 55. Downstream end 43 can be mounted within bore 56 of plate 55, such as shown in FIGS. 1-3 and 9, to form fluidic communication between outlet 44 and bore 56. The assembled structure formed by nozzle 40, plate 50 and plate 55 forms space 58, or another suitable void, between plates 50 and 55. In certain embodiments of this invention, space 58 can be used to provide pressurized fluid 25 to passageway 48 of nozzle 40. Nozzle 40 can be attached, secured, connected or otherwise mounted with respect to plate 50 and/or plate 55, using any other suitable mechanical connection or integral material. In some embodiments according to this invention, nozzle 40 and plates 50 and 55 are sealably attached with respect to each other, to prevent pressurized fluid 25 from leaking through the formed structure of distributor 39.

One common space 58 can be used to provide pressurized fluid 25 to each nozzle 40. In other embodiments according to this invention, space 58 can be divided into two or more separate portions, such as by using one or more baffle structures or any other suitable valving arrangement. Manifold 60, such as shown in FIG. 12, can be used in addition to or in lieu of space 58, to deliver pressurized fluid 25 to each nozzle 40. Two or more manifolds 60 can be used to independently control flow parameters of pressurized fluid 25 through nozzle 40. The different portions and/or different manifolds 60 can be used to provide different flow parameters of pressurized fluid 25 to at least two of nozzles 40.

Controller 70 can be programmed or otherwise used to determine at least one flow parameter at which pressurized fluid 25 is delivered to each of nozzles 40. Controller 70 can emit a signal to a control device, such as a control valve shown in FIG. 12 or another suitable regulator, to manage or change any flow parameter of pressurized fluid 25. The flow parameters can be changed simultaneously to the different nozzles 40. In addition to or in lieu of the simultaneous flow control to each nozzle 40, controller 70 can also change flow conditions over a given time period while maintaining the same flow conditions at two or more of nozzles 40.

As shown in FIG. 2, nozzle 40 comprises at least one opening 46 which is exposed to or in fluidic communication with passageway 48 of nozzle 40. Opening 46 forms communication with pressurized fluid 25, for example within space 58 and/or within manifold 60. As shown in FIG. 2, each opening 46 is a through bore. However, opening 46 may comprise any other suitable void, tube, pipe or other communication device that can form fluidic communication between passageway 48 and a source of pressurized fluid 25. The number of openings 46, and the size and orientation of each opening 46 can be varied or designed to accomplish one or more different flow conditions, flow parameters and/or flow patterns within passageway 48. Opening 46 can also be positioned or directed to create a swirling flow within and/or downstream of nozzle 40.

One or more nozzles 40 can be adjustably mounted with respect to mold 30, including cope flask 31 and/or drag flask 33. For example, nozzle 40 can have a gimbal mount adjustably positionable with respect to cope flask 31 and/or drag flask 33, that provides rotational movement about one or more of three different axes. A gimbal mount can be used to position or aim nozzle 40, for example at or near pattern 36 or 37 positioned within void 32 or 34.

In certain embodiments according to this invention, in addition to or in lieu of the gimbal mount, at least one nozzle 40 can be moveably mounted or positionable with respect to cope flask 31 and/or drag flask 33. For example, nozzle 40 can be manually and/or automatically, such as through a programmed robotic control, moved in any one or more of three dimensions. Each nozzle 40 can be moved and/or repositioned by using any suitable programmed controller and a positioning device.

Figure 3:
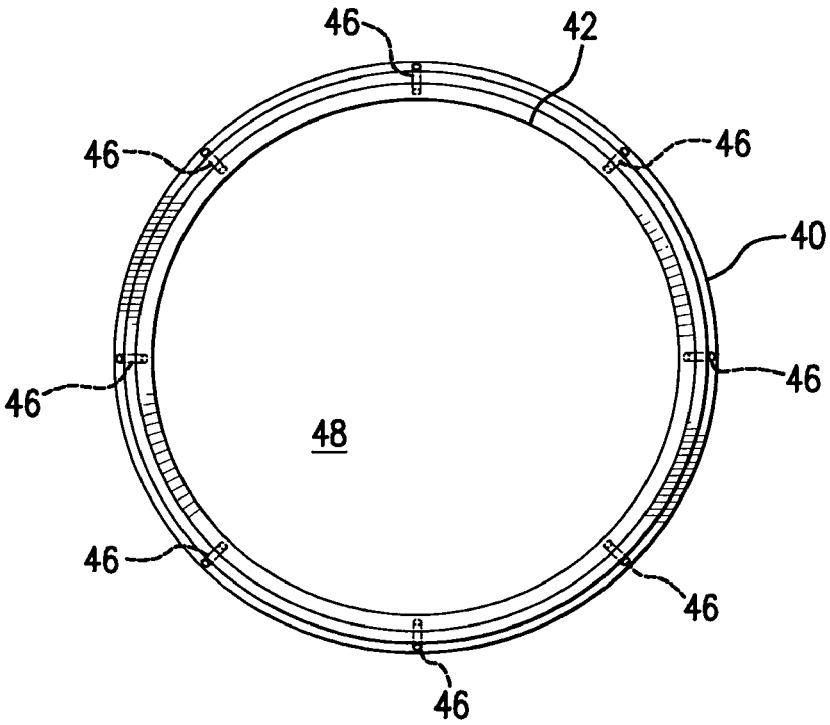
FIG. 3 is a top view of the nozzle, as shown in FIG. 2.

As shown in FIG. 2, nozzle 40 has a generally straight passageway 48, with a central portion that slightly converges in the downstream direction. Each nozzle 40 may comprise a straight nozzle, a converging nozzle, a diverging nozzle and/or a converging-diverging nozzle. Passageway 48 can have any other suitable shape that can be used to accelerate particles 21 through passageway 48. FIG. 3 shows a top view of nozzle 40 having a generally circular cross section of passageway 48. However, in other embodiments of this invention, passageway 48 can have a square or rectangular cross section or any other suitable non-circular cross section.

Nozzle 40 can also be referred to as an accelerator or an acceleration device. In some embodiments of this invention, each nozzle 40 is an independent structure. In other embodiments of this invention, two or more nozzles 40 are combined to form one structure or housing. For example, two or more nozzles 40 can be formed as bores or passageways 48 through a single or integrated structural element.

Downstream end 43 of distributor 39 and/or a downstream surface of plate 55 can be spaced at a distance from an upstream surface of mold 30, including cope flask 31 or drag flask 33. The distance can be sized to form an opening or a gap that sufficiently allows pressurized fluid 25 to escape from within void 32 or 34, such as when particles 21 are discharged from nozzle 40. FIG. 1 shows gap 59 between bottom or downstream plate 55 and the upstream surface of cope flask 31. Gap 59 can be used to eliminate the need for a conventional flask body to have a vent structure that allows air but not sand or particles 21 to pass through the flask structure, such as when sand is pneumatically blown through a device that is sealed with respect to the flask body. Gap 59 of this invention can be used to reduce or eliminate spillage or waste sand.

Figure 10:
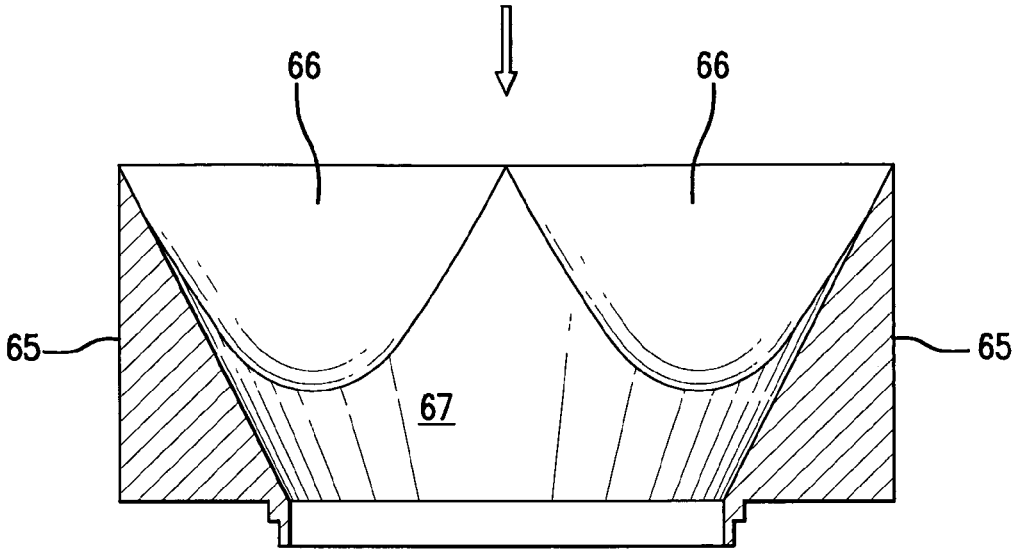
FIG. 10 is a sectional view of a funnel, according to one embodiment of this invention.
Figure 11:
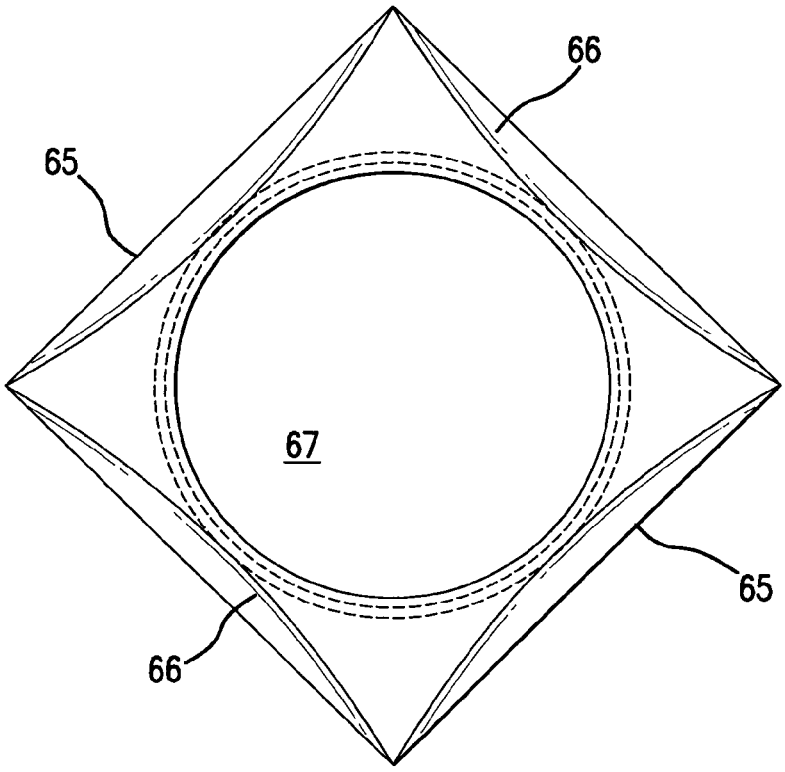
FIG. 11 is a top view of the funnel, as shown in FIG. 10.

FIGS. 1, 10 and 11 show one embodiment of funnel 65. Funnel 65 can be mounted to an upstream end of a corresponding nozzle 40. As shown in FIG. 10, funnel 65 has passageway 67 for passing particles 21 from supply 22 to inlet 42 of nozzle 40. As used throughout this specification and in the claims, the term funnel is intended to be interchangeable with the term funnel inlet and/or collector, and each of these terms is intended to relate to a structural element that has passageway 67 converging in the downstream direction, such as toward the corresponding nozzle 40. The converging shape can be used to better distribute, evenly or unevenly, particles 21 into passageway 48 of nozzle 40.

FIGS. 10 and 11 show collector 65 having four scalloped surfaces 66. With scalloped surfaces 66, two or more collectors 65 can be positioned adjacent or next to each other to reduce or eliminate horizontal surfaces which are otherwise exposed to supply 22 of particles 21. Any horizontal surface that exists can collect or hold particles 21, which normally is undesirable in manufacturing operations.

In one embodiment according to this invention, a method for transferring particles 21 into void 32 or 34 includes passing particles 21 through two or more nozzles 40, each mounted with respect to molding machine 20, mold 30 and/or cope flask 31 or drag flask 33. Pressurized fluid 25 is drawn into or passes through each nozzle 40 and thus accelerates particles 21 within or through passageways 48 of nozzles 40. Particles 21 are then discharged through outlet 44 of each nozzle 40, and into void 32 or 34, at or near pattern 36 or 37. Any flow parameter through nozzle 40 and/or any position of nozzle 40 can be varied, for each particular use or even as a function of time, and can be controlled manually and/or automatically, to accomplish any desired continuous or intermittent transfer of particles 21 into void 32 or 34.

In certain embodiments of this invention, pressurized fluid 25 establishes or creates a Coanda effect where a fluid stream follows or attaches to an inner surface of nozzle 40. For example, as shown in FIG. 12, when pressurized fluid 25 exits or discharges from or through opening 46, one or more fluid streams each is formed and can follow, attach to or hug the inner surface, such as the inner converging surface, of nozzle 40. The Coanda effect can result in better compaction of particles 21, at or near pattern 36 or 37. The size and position of opening 46 can be designed differently to accomplish any desired Coanda effect or other flow parameter effect.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. A method for transferring particles into a void formed by a flask of a molding machine, the method comprising:

passing particles through a plurality of nozzles each mounted with respect to the molding machine;

passing a pressurized fluid through each of the nozzles and accelerating the particles through passageways of the nozzles;

discharging the particles through an outlet of each of the nozzles and into the void of the flask;

passing the discharging particles through a space formed by a gap between the outlet and a top of the flask; and venting the pressurized fluid radially through the gap between the outlet and the top of the flask during the passing of the discharging particles through the space.

2. The method according to claim 1, wherein the at least one nozzle has a gimbal mount.

3. The method according to claim 1, wherein the at least one nozzle is movable in at least one of three dimensions with respect to the flask.

4. The method according to claim 1, wherein one of the outlet and an outer surface of a structure to which the outlet is mounted is spaced at a distance from an upstream portion of the flask.

5. The method according to claim 1, further comprising gravity feeding the particles from a supply into the passageways of the nozzles, wherein the pressurized fluid accelerates the gravity fed particles within the passageways.

6. The method according to claim 1, wherein the particles comprise sand.

7. The method according to claim 1, wherein discharged particles are one of automatically or manually aimed into the void of the flask.

8. The method according to claim 1, wherein upstream of the nozzles, the particles pass through a plurality of funnels that converge in a direction toward the corresponding nozzle.

9. The method according to claim 1, wherein a controller determines at least one flow parameter of the pressurized fluid passing through each of the nozzles and emits a control signal to a regulator controlling a flow of the pressurized fluid through at least one of the nozzles.

10. The method according to claim 1, wherein the nozzles through which the pressurized flow passes comprise at least one of a straight nozzle, a converging nozzle, a diverging nozzle, and a converging-diverging nozzle.

11. The method according to claim 1, wherein the nozzles comprise at least one of a pressurized fluid inlet, a Coanda profile, and a mixed fluid outlet.

12. The method according to claim 1, wherein the nozzles through which the pressurized flow passes comprise a nozzle outlet shape selected from the group consisting of round, square, rectangular, and combinations thereof.

13. The method according to claim 1, further comprising delivering a pressurized fluid into each of the nozzles downstream of the inlet to accelerate the particles through the passageways of the nozzles.

14. A method for transferring particles into a void formed by a flask of a molding machine, the method comprising:

gravity feeding particles from a particle supply to a distributor positioned between the particle supply and the flask, the distributor comprising an array of a plurality of nozzles each including a passageway extending between an inlet and an outlet;

passing the gravity fed particles through the inlets of the plurality of nozzles and into the passageways of the plurality of nozzles;

introducing a pressurized fluid into the passageway of each of the nozzles at a position between the inlet and the outlet of each of the nozzles to accelerate the gravity fed particles within the passageways of the nozzles; and discharging the accelerated particles through the outlets of the nozzles and into the void of the flask.

15. The method according to claim 14, further comprising creating a Coanda effect in the nozzles by delivering the pressurized fluid.

16. The method according to claim 14, further comprising delivering the pressurized fluid into the nozzles through openings in the nozzles that are angled toward the outlet.

17. The method according to claim 14, further comprising forming a plurality of fluid streams in each of the nozzles that follow an inner surface of the nozzles.

18. The method according to claim 14, further comprising supplying the pressurized fluid to the nozzles through at least one manifold.

19. The method according to claim 14, wherein the nozzles are sealably mounted between a first plate and a second plate, and further comprising passing the pressurized fluid through a space between the first plate and the second plate and to the nozzles.

20. The method according to claim 14, wherein each of the nozzles is attached to a first plate and a second plate, the first plate including a plurality of through bores each in fluidic communication with the inlet of a corresponding nozzle of the nozzles, and the second plate including a plurality of second through bores each in fluidic communication with the outlet of the corresponding nozzle.

21. The method according to claim 14, further comprising passing the particles through a plurality of funnels each mounted to an upstream end of a corresponding nozzle of the nozzles, and each of the funnels converging in a direction toward the corresponding nozzle.

22. The method according to claim 21, wherein each of the funnels has at least one scalloped surface exposed to the supply of the particles.

23. The method according to claim 14, further comprising determining with a controller at least one flow parameter at which the pressurized fluid is delivered to each of the nozzles and emitting with the controller a signal to a regulator controlling a flow of the pressurized fluid.

24. The method according to claim 14, further comprising operating at least two of the nozzles at different flow conditions.

25. The method according to claim 14, wherein the nozzles comprise at least one of a straight nozzle, a converging nozzle, a diverging nozzle, and a converging-diverging nozzle.

26. The method according to claim 14, further comprising passing the discharging particles through a space formed by a gap between the outlet and a top of the flask.

* * * * *